US009467783B2

(12) United States Patent
Bullimore

(10) Patent No.: US 9,467,783 B2
(45) Date of Patent: Oct. 11, 2016

(54) LOW PROFILE LOUDSPEAKER TRANSDUCER

(71) Applicant: Tymphany Worldwide Enterprises Limited, Grand Cayman (KY)

(72) Inventor: George Bullimore, Vale of Glamorgan (GB)

(73) Assignee: TYMPHANY WORLDWIDE ENTERPRISES LIMITED, Grand Cayman (KY)

( * ) Notice: Subject to any disclaimer, the term of this patent is extended or adjusted under 35 U.S.C. 154(b) by 0 days.

(21) Appl. No.: 14/519,243

(22) Filed: Oct. 21, 2014

(65) Prior Publication Data

US 2015/0117698 A1 Apr. 30, 2015

Related U.S. Application Data

(60) Provisional application No. 61/895,653, filed on Oct. 25, 2013.

(51) Int. Cl.

| | |
|---|---|
| ***H04R 9/04*** | (2006.01) |
| ***H04R 7/16*** | (2006.01) |
| *H04R 9/02* | (2006.01) |

(52) U.S. Cl.

CPC ..... *H04R 7/16* (2013.01); *H04R 9/043* (2013.01); *H04R 9/02* (2013.01); *H04R 2209/022* (2013.01)

(58) Field of Classification Search

CPC ..... H04R 7/16; H04R 7/18; H04R 7/20; H04R 7/22; H04R 7/24; H04R 7/26; H04R 9/025; H04R 9/04; H04R 9/041; H04R 9/043; H04R 9/045; H04R 9/02; H04R 7/127; H04R 7/14

USPC ..... 381/398, 407, 412, 413, 420, 423, 424, 381/430, 397, 404–405; 181/171–172

See application file for complete search history.

(56) References Cited

U.S. PATENT DOCUMENTS

| | | | | |
|---|---|---|---|---|
| 5,511,131 | A * | 4/1996 | Kohara et al. | 381/396 |
| 6,782,114 | B2 * | 8/2004 | Ando | H04R 7/20 181/171 |
| 6,836,551 | B2 * | 12/2004 | Kuze | H04R 9/06 381/403 |
| 6,863,152 | B1 * | 3/2005 | Sahyoun | H04R 7/20 181/157 |
| 7,054,459 | B2 * | 5/2006 | Kuze | H04R 7/20 181/172 |
| 7,236,607 | B2 * | 6/2007 | D'Hoogh | 381/396 |
| 7,325,650 | B2 * | 2/2008 | Horigome | H04R 9/041 181/166 |

(Continued)

*Primary Examiner* — Davetta W Goins
*Assistant Examiner* — Jasmine Pritchard
(74) *Attorney, Agent, or Firm* — Cantor Colburn LLP

(57) ABSTRACT

A low profile loudspeaker transducer is presented with an arrangement of placing the motor up near or into the inside concave portion of a convex dome or inverted convex cone diaphragm. In some preferred embodiments the low profile structure is facilitated by an inverted placement of the spider suspension above the plane of the surround suspension to stabilize the voice coil during excursion while supporting a low profile structure. Additionally, in numerous embodiments a coupling structure is utilized between the voice coil former and the diaphragm to create a broad surface area connection to the diaphragm to create a stiffer structure and minimizing breakup modes and creating a more robust mechanical structure to withstand greater output capability.

10 Claims, 16 Drawing Sheets

(56) References Cited

U.S. PATENT DOCUMENTS 7,570,776 B2 * 8/2009 Watanabe ..... H04R 7/18 381/353
2005/0276435 A1 * 12/2005 Watanabe ..... H04R 1/06 381/399
2006/0120555 A1 * 6/2006 Watanabe ..... 381/398
2006/0137935 A1 * 6/2006 Nevill ..... H04R 7/14 181/174
2006/0182302 A1 * 8/2006 Onodera ..... 381/397
2007/0189571 A1 * 8/2007 Corynew ..... H04R 7/14 381/396
2008/0159583 A1 * 7/2008 Tanaka ..... H04R 1/24 381/398
2009/0226028 A1 * 9/2009 Suganuma ..... H04R 7/06 381/430
2010/0183187 A1 * 7/2010 Corynen ..... 381/398

* cited by examiner

LOW PROFILE LOUDSPEAKER TRANSDUCER

CROSS REFERENCE TO RELATED APPLICATION

This application is related to and claims the benefit of U.S. provisional application Ser. No. 61/895,653 filed on 25 Oct. 2013, the contents of which are herein incorporated by reference in their entirety.

TECHNICAL FIELD

This invention is in the category of electro-acoustical transducers, more specifically, it is in the category of transducers utilized in loudspeaker systems.

BACKGROUND

In the audio field it is desirable for loudspeakers to be configured for utilization in smaller and thin form-factor products while maintaining fidelity.

The modern consumer electronics market demands integrated loudspeakers within audio products with more and more functions (such as: wireless connection chip sets; larger user interfaces; audio signal processing modules; amplification; rechargeable batteries; etc.) all packaged within compact designs. These constraints generally lead to increasing the size of the associated electronics and reducing the dimensions of the package size dedicated to the loudspeaker enclosure volumes. Additionally, there are a number of other applications where shallow cabinet designs are also incorporated, such as those within very thin television screens where a considerable reduction of the effective cabinet depth and volume can compromise the performance of the transducers.

Small transducers are commonly chosen as a solution for such systems since they require lesser acoustic volume than conventional-sized speakers. Nevertheless, it is well known that small transducers present poor efficiency and limited output when reproducing low frequencies at high levels as a consequence of compromised parameters, including limited diaphragm surface area and cubic volume displacement.

There is a need for an improved transducer that can be incorporated into smaller or thin profile audio products while achieving the desired acoustical output and high fidelity.

BRIEF SUMMARY OF THE INVENTION

With the invention is created a simple and effective transducer, which can maintain the diaphragm surface area and displacement of the conventional-sized transducers while significantly reducing the transducer height profile. In a preferred embodiment the low profile loudspeaker transducer may incorporate an inverted relationship between the surround suspension and the spider suspension with the spider suspension placed above the surround suspension housed within the volume of a projecting dome or inverted diaphragm, allowing a shallower structure while maintaining stability and reducing rocking of the voice coil in the voice coil gap during diaphragm excursions. In many of the preferred embodiments a coupling member acts as an intermediate connector between the voice coil former and the diaphragm, providing an increased contact surface area attachment and support to the diaphragm. These and other forms and advantages will become apparent with the ongoing specification disclosed below.

BRIEF DESCRIPTION OF THE DRAWINGS

The figures depict preferred embodiments of the present invention for the purposes of illustration only. One skilled in the art will readily recognize from the following discussion that alternative embodiments of the structure and methods illustrated herein may be employed without departing from principles of the invention described.

DETAILED DESCRIPTION

Figure 1A:
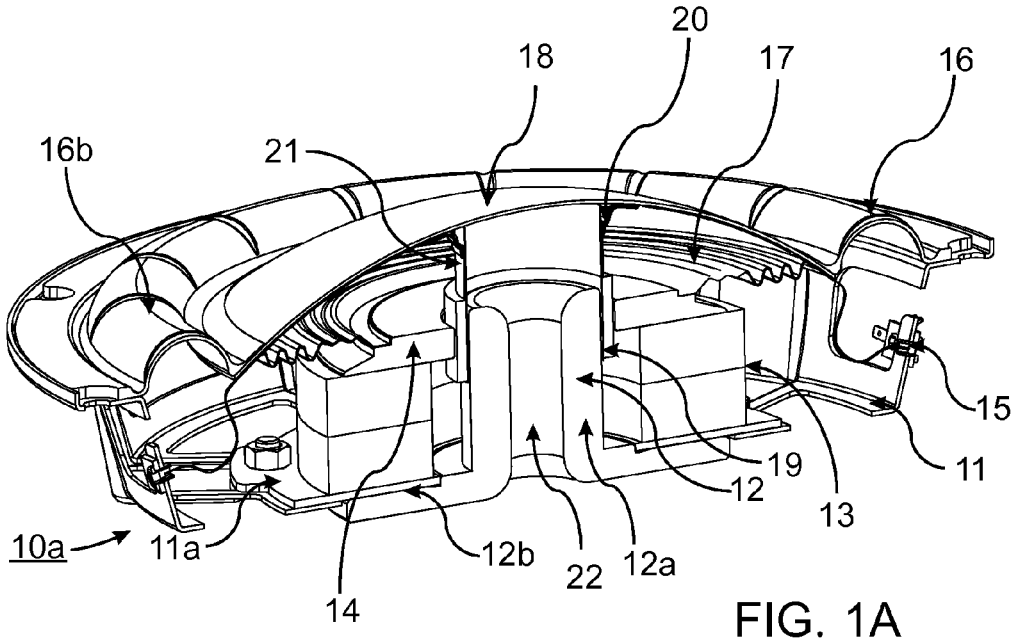
FIG. 1A is a cut-away view of a first example loudspeaker transducer of the invention.

The mechanical and magnetic structures of a loudspeaker transducer constructed in accordance with, and embodying, the principles of the present invention may take many forms depending on factors such as the nature of the system packaging, the desired frequency response, output capability, and/or the level of linearity that is considered desirable. The target price of a particular magnetic transducer of the present invention will also be a factor, with improved frequency response, maximum output capability, and increased linearity being generally associated with increased cost.

Accordingly, a number of different examples of the present invention will be described below. In the following discussion, elements that are or may be common among the various examples may be assigned the same reference character.

Referring initially to FIGS. 1 and 1A, depicted therein is a first example of a preferred embodiment of low profile loudspeaker transducer 10*a* of the present invention. The first example transducer 10*a* comprises a frame 11 which is coupled to T-Yoke 12, preferably constructed of ferrous material and in this example is shown to be formed with vented pole piece opening 22. This and other embodiments may be constructed with or without a vented opening in the Y-Yoke. An connecting spacer 11*a* may be used as an intermediary coupling plate interfacing with the back plate 12*a* of T-Yoke 12 and magnet structure 13, which is shown in FIG. 1 with two stacked ring magnets and in FIG. 2 with 1 ring magnet, which may consist of ceramic or ferrite materials, but may incorporate any of a wide variety of magnet materials normally utilized in the field loudspeaker transducers.

Figure 1B:
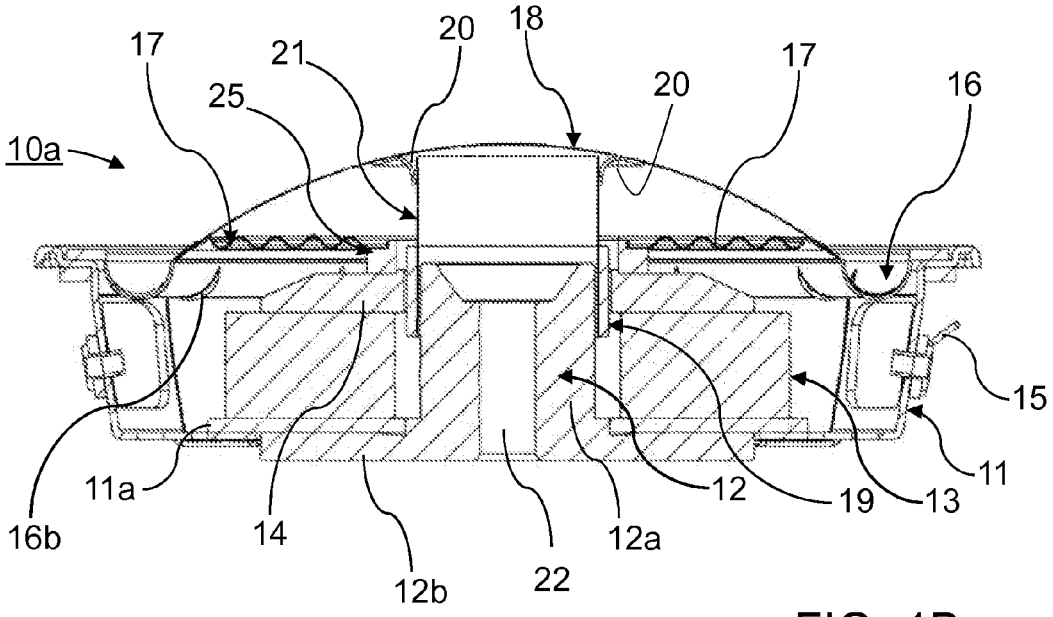
FIG. 1B is a cross-sectional view of another example loudspeaker transducer of the invention.

Preferably ferrous, top plate 14 is coupled to the top of magnet structure 13 forming a magnetic circuit with, preferably ferrous, T-Yoke 12 and back plate 12*a*. Diaphragm 18 is shown in this embodiment in FIGS. 1A and 1B as a seamless, convex dome connected to frame 11 through concave or convex form (inverted and non-inverted forms respectively), compliant surround suspension 16. The present invention does not restrict the shape of the surround thus, any surround form traditionally implemented in acoustic transducers can be considered, like multi-roll surround, double surround or single surround forms. That is, FIGS. 1A and 1B show a single surround 16. However, in other embodiments of the invention, the transducer 10A may include one or more additional surround suspensions disposed radially outward of the illustrated surround 16 and/or radially inward thereof. The additional surround suspension(s) may be shaped similarly to or differently from the surround suspension 16. Moreover, the surround suspension 16 and/or any additional surround suspensions can possess any desirable shape. For example, the surround suspensions may have a convex or concave curvilinear cross-sectional shape as shown respectively in FIGS. 1A and 1B or, alternatively, the surround suspensions may have a linear cross-sectional profile or a profile having both linear and curvilinear aspects. Surround suspension 16 is shown here with ribs 16*b* in FIGS. 1A and 1B, but the surround suspension may be configured with or without ribs, and surround suspension 16 may also be configured as a non-inverted, convex form, as shown as 16*a* in FIG. 3.

Diaphragm 18 is coupled to voice coil former 21 through coupler 20, which in connected between diaphragm 18 and voice coil former 21. In this preferred embodiment, voice coil former 21 is not directly connected to diaphragm 18. Electrically conductive voice coil 19 is attached to voice coil former 21 and suspended in a magnetic field gap between top plate 14 and the top of T-Yoke 12 without being in contact with T-Yoke 12 and top plate 14.

Diaphragm 18 is also attached to, and suspended by, spider suspension 17, which is attached to top plate 14, and positioned in a plane above surround suspension 16 to provide stability to diaphragm 18 to minimize rocking of the voice coil 19 during dynamic excursions of diaphragm 18. FIG. 1B exhibits a ring separator 25 which connects the inner periphery of the spider suspension 17 to the top plate 14. This ring separator helps to control the spider suspension fixation points both to the diaphragm 18 and the magnetic motor structure. In the illustrated exemplary embodiment, the ring separator 25 is disposed on top of the top plate 14 and extends annularly thereon around the voice coil former 21 and around the electrically conductive voice coil 19. The ring separator has a generally square cross-sectional shape and may include a seat on its upper surface for receiving and retaining an end of the spider suspension 17. The ring separator 25 may extend continuously or discontinuously around the voice coil former 21 and it may possess a cross-sectional shape having curvilinear and/or rectilinear aspects. The ring separator 25 may extend upon the top plate 14 in an annular fashion, as illustrated, or in any other desired geometry, e.g., pentagon, hexagon, oval, diamond shape, etc.

Input terminal 15 is adapted to receive an audio input signal and conductive wires (not shown) connect input terminal 15 to voice coil 19.

Figure 2:
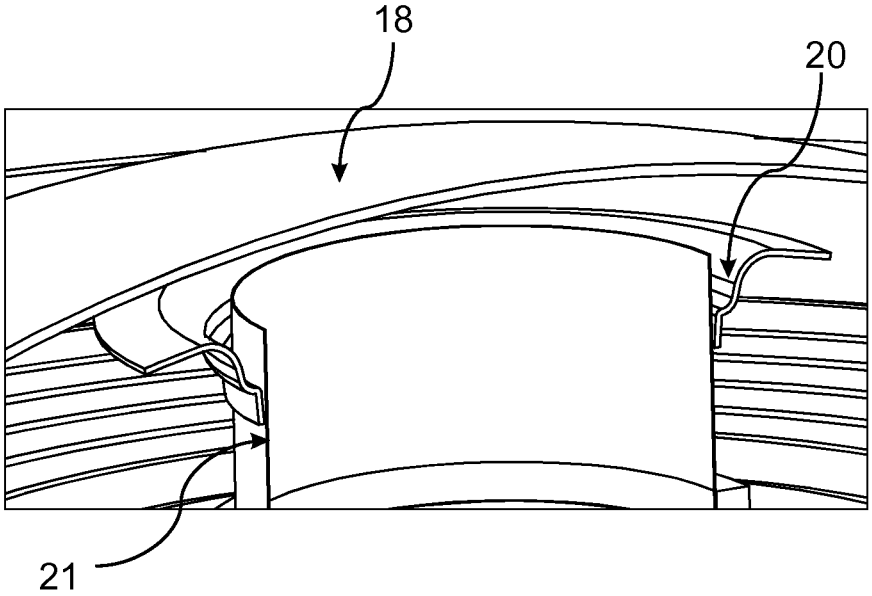
FIG. 2 is a close-up cut-away view of the first example loudspeaker transducer of the invention.

FIG. 2 is a close up cutaway of the same basic device of FIG. 1 showing in expanded detail an example of coupler 20 and how it interfaces with voice coil former 21. For illustrative purposes, diaphragm 18 is spaced away from coupler 20. It can be seen that coupler 20 has a broader surface area than the top of voice coil former 21, such that upon being coupled to the diaphragm, coupler 20 creates a larger connection interface with greater diaphragm/coupler integrity, less diaphragm breakup and more pistonic diaphragm mobility over a greater bandwidth. Coupler 20 can be directly connected to diaphragm 21 or can be coupled through a compliant or damped interface material. Coupler 20 can also have different regular or irregular geometries for its outer edge, it cannot only be shaped in a circle but it can exhibit a pentagon, hexagon and so forth.

Figure 3:
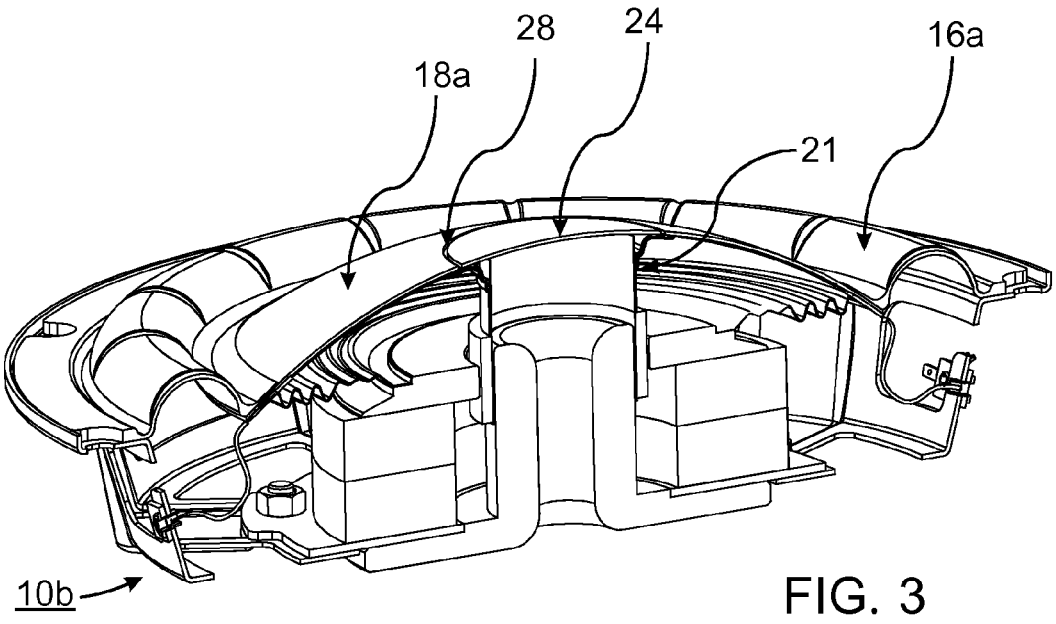
FIG. 3 is a cut-away view of a second example loudspeaker transducer of the invention.
Figure 3A:
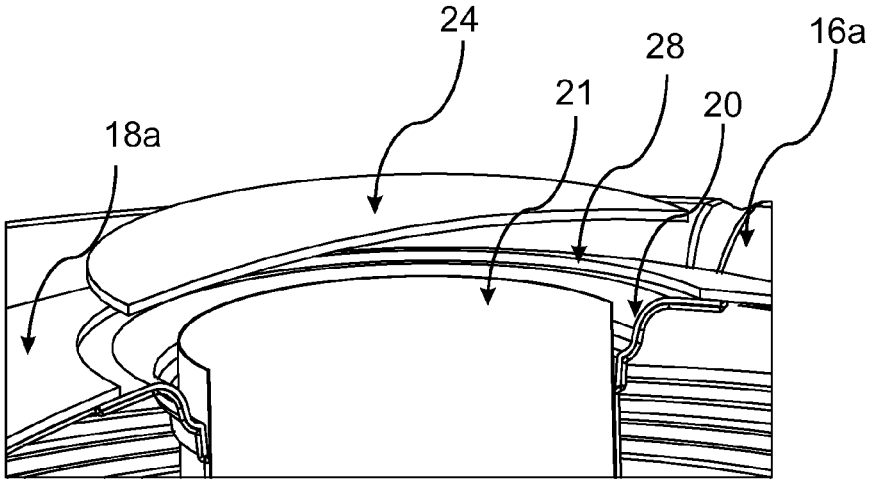
FIG. 3A is a close-up cut-away view of the second example loudspeaker transducer of the invention.

FIG. 3 shows a cut-away view and FIG. 3A a close up view that depicts a second example low profile loudspeaker transducer device 10*b*. The second example 10*b* is similar to the device in FIG. 1 but with surround 16*a* shown as a non-inverted, convex configuration, and dome diaphragm 18*a* is a two-part diaphragm, including a central cutout opening 28 with central dust cap cover 24 to complete the diaphragm 18*a*, and the diaphragm 18*a* being attached to coupler 20 and convex central dust cap 24 being attached to either one or both of coupler 20 and voice coil former 21.

Figure 4:
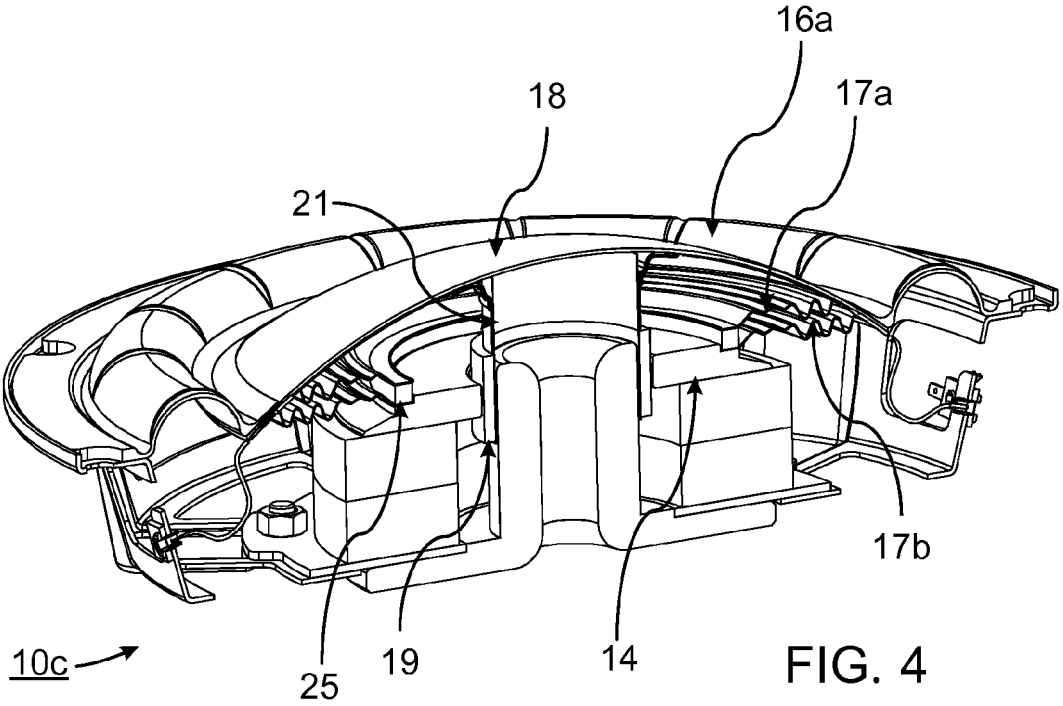
FIG. 4 is a cut-away view of a third example loudspeaker transducer of the invention.
Figure 4A:
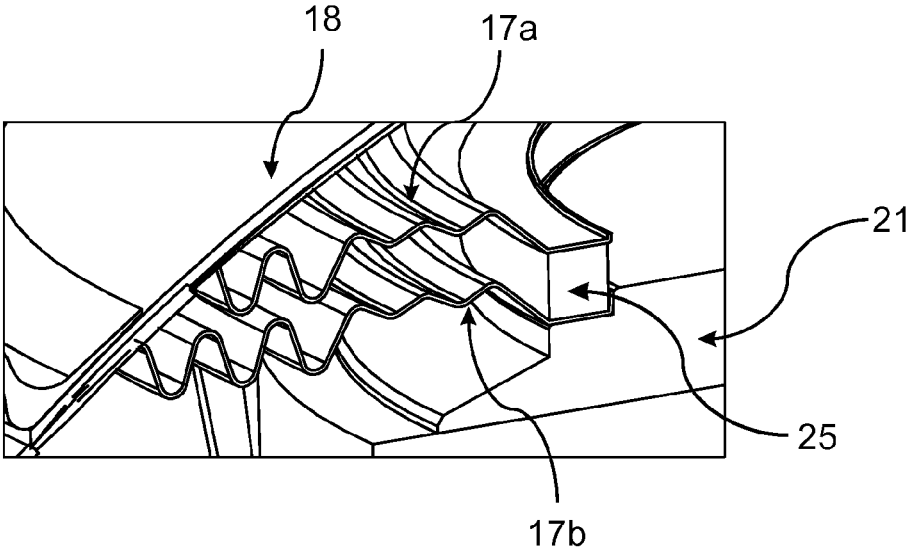
FIG. 4A is a close-up cut-away view of the third example loudspeaker transducer of the invention.

FIG. 4 shows a cut-away view and FIG. 4A a close up view that depicts a third example low profile loudspeaker transducer device 10*c*. The third example 10*c* is essentially the same as the device of FIG. 1 but with surround suspension 16*a* shown as a non-inverted, convex configuration. Throughout the various examples the inverted, concave surround suspension and non-inverted convex surround suspension may be used interchangeably. Device 10*c* is optimized for use as a woofer or subwoofer application for reproducing low frequencies which may demand greater excursions of the diaphragm 18 for which greater linear excursion can be realized with the application of dual spider suspensions 17*a* and 17*b* attached to the outer portion of diaphragm 18 and to ring separator 25, which is mounted on top plate 14. Here, the top plate 14 can include a seat for receiving and retaining the ring separator 25. In the illustrated embodiment, the ring separator 25 is an annular shaped member with a generally rectilinear cross-sectional profile having one of the spider suspensions 17*a* mounted on an upper side of the separator 25 and the other suspension 17*b* mounted on a lower side of the separator 25. As discussed with reference to FIG. 1B, the ring separator 25 can include any desired cross-sectional shape and can traverse across the top plate 14 in any desired configuration to provide continuous or discontinuous attachment of the spider suspensions. The dual spider suspension 17*a* and 17*b* acts as a more stable centering device, maintaining positioning of voice coil 19 and keeping it from rubbing against top plate 14 during large signal low frequency excursions.

Figure 5:
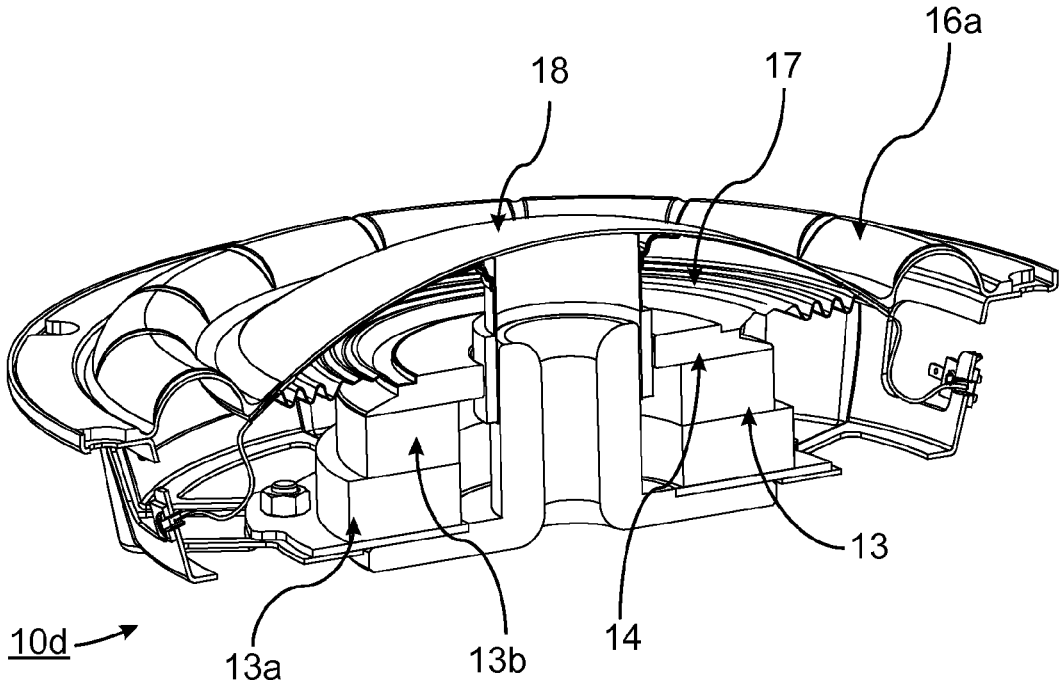
FIG. 5 is a cut-away view of a fourth example loudspeaker transducer of the invention.

FIG. 5 shows a cut-away view that depicts a fourth example low profile loudspeaker transducer device 10*d*. The fourth example 10*d* is essentially the same as the device of FIG. 1 but with surround suspension 16*a* shown as a non-inverted, convex configuration and magnet structure 13 including two ring magnets 13*a* and 13*b* with ring magnet 13*b* having a greater outside diameter, greater amount of magnet material and greater magnetic energy such that the magnet structure 13 has greater total magnetic energy. This may be used to increase total magnetic energy or to create greater clearance for greater excursion of diaphragm 18 and spider suspension 17 relative to top plate 14 and top magnet 13*b*.

Figure 6:
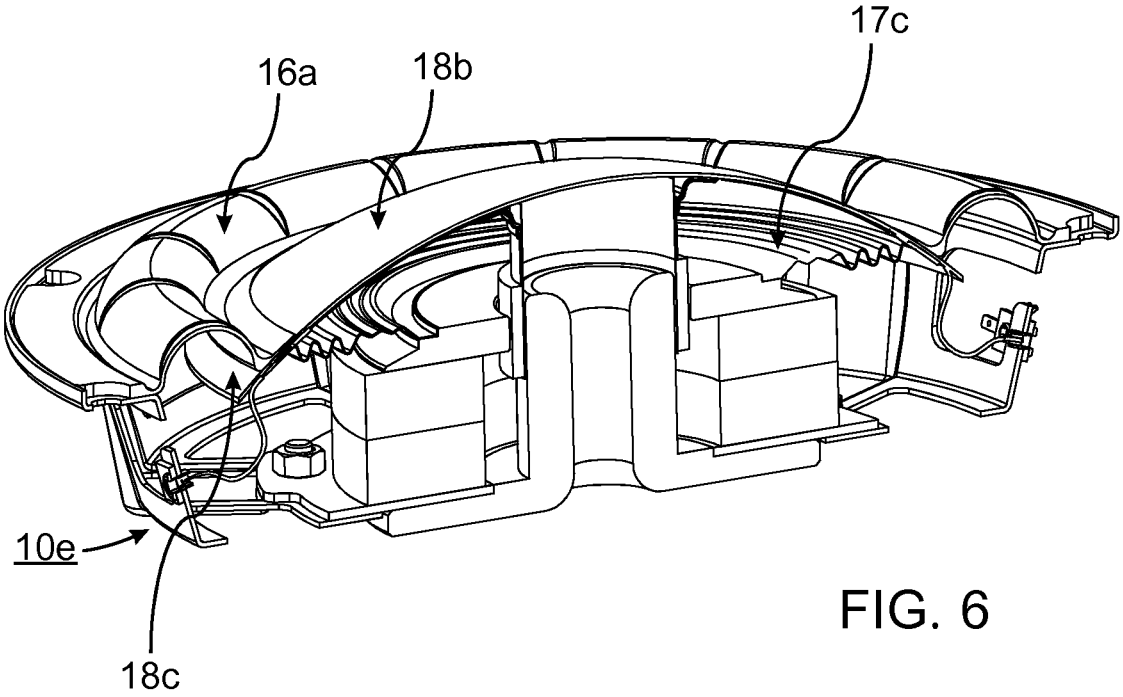
FIG. 6 is a cut-away view of a fifth example loudspeaker transducer of the invention.
Figure 6A:
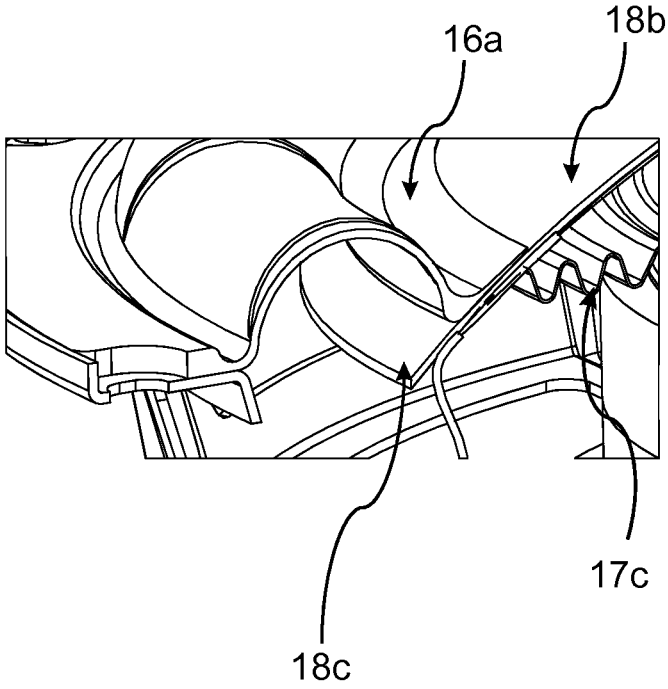
FIG. 6A is a close-up cut-away view of the fifth example loudspeaker transducer of the invention.

FIG. 6 shows a cut-away view and FIG. 6A a close up view that depicts a fifth example low profile loudspeaker transducer device 10*e*. Referring to the device in FIG. 1, the fifth example 10*e* is incorporates the differences of surround suspension 16*a* shown as a non-inverted, convex orientation and diaphragm 18*b* has an extended outer diameter 18*c* extending beyond the point of attachment of surround suspension 16*a* to diaphragm 18*b*. Additionally, loudspeaker transducer 10*e* utilizes the larger diameter diaphragm extension to advantage by positioning the stabilizing spider suspension 17*c* attachment to diaphragm extension 18*c* below that of surround suspension 16*a*.

Figure 18:
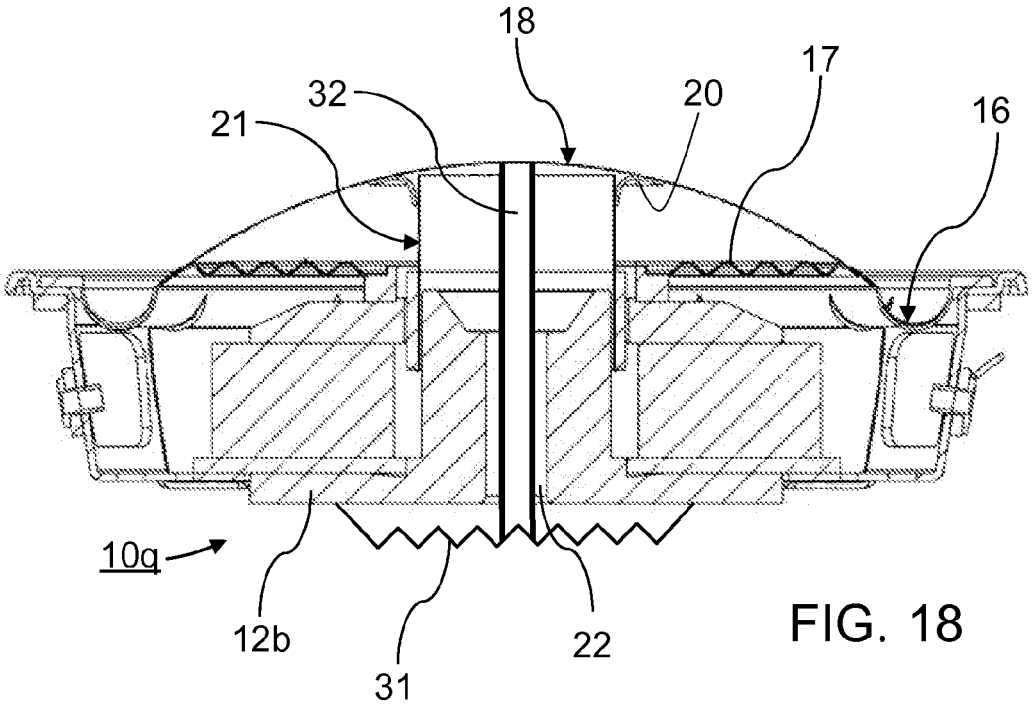
FIG. 18 is a cross-sectional view of a seventeenth example loudspeaker transducer of the invention.

In the various preferred embodiments of the invention the spider suspension 17*c* may be attached or positioned above or below the plane of the surround suspension 16*a* and in certain embodiments may be attached or positioned substantially in the same plane as the surround suspension 16*a*. As seen in FIG. 18, a spider suspension 31 may be place well below the surround suspension 16, even on the bottom of the transducer behind back plate 12*b*.

Figure 7:
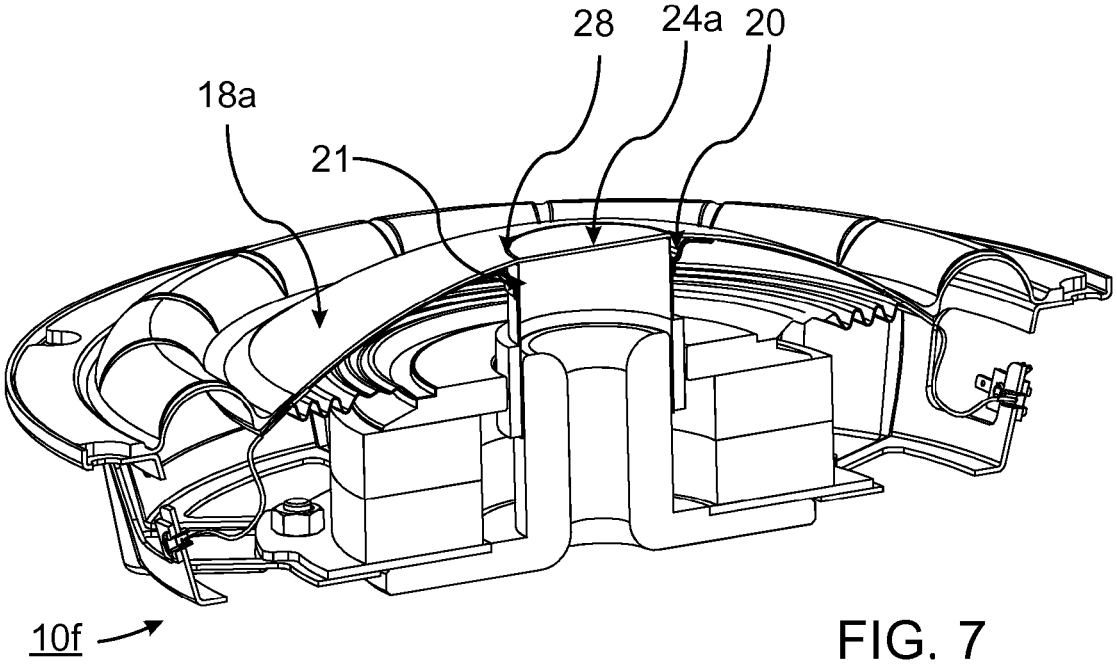
FIG. 7 is a cut-away view of a sixth example loudspeaker transducer of the invention.
Figure 7A:
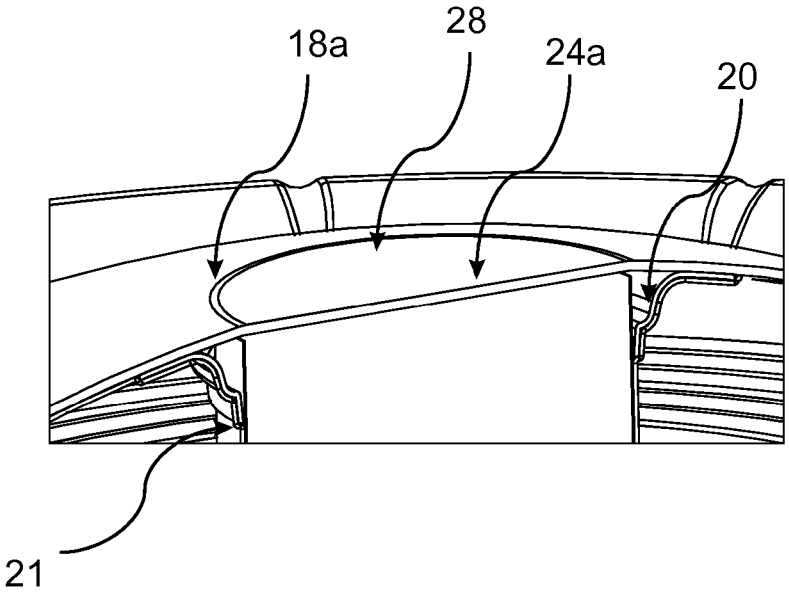
FIG. 7A is a close-up cut-away view of the sixth example loudspeaker transducer of the invention.

FIG. 7 shows a cut-away view and FIG. 7A a close up view that depicts a sixth example low profile loudspeaker transducer device 10*f*. The sixth example 10*f* is similar to the device in FIG. 1 but with surround 16*a* shown as a non-inverted, convex configuration, and convex dome diaphragm 18*a* including a central cutout opening 28 with central flat dust cap cover 24 mounted to complete the diaphragm 18*a*. The diaphragm 18*a* is attached to coupler 20 and flat central dust cap 24 may be attached to either one or both of diaphragm 18*a* and voice coil former 21.

Figure 8:
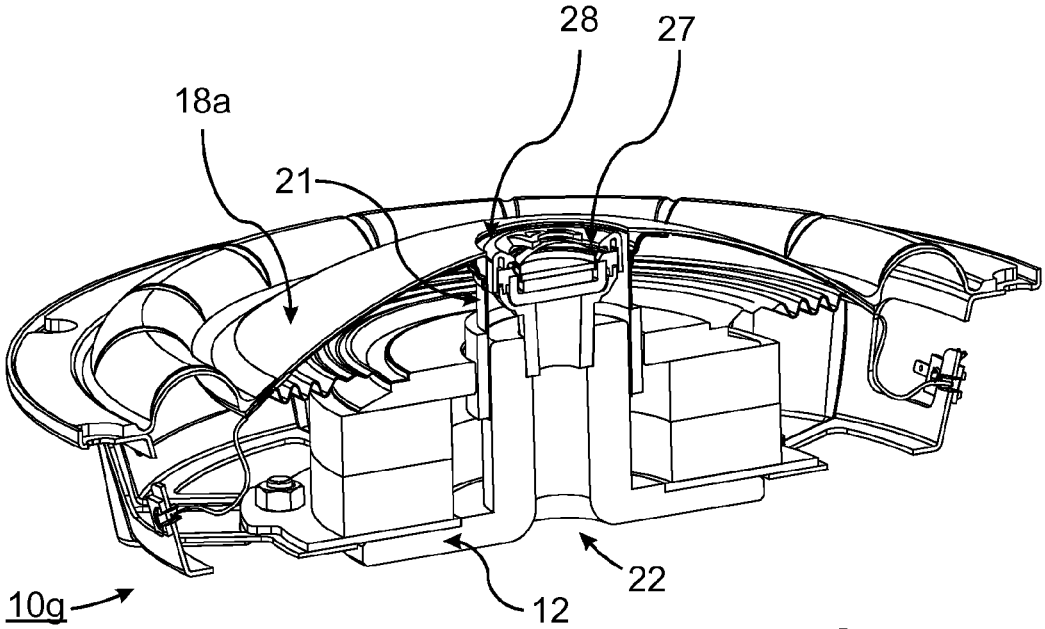
FIG. 8 is a cut-away view of a seventh example loudspeaker transducer of the invention.
Figure 8A:
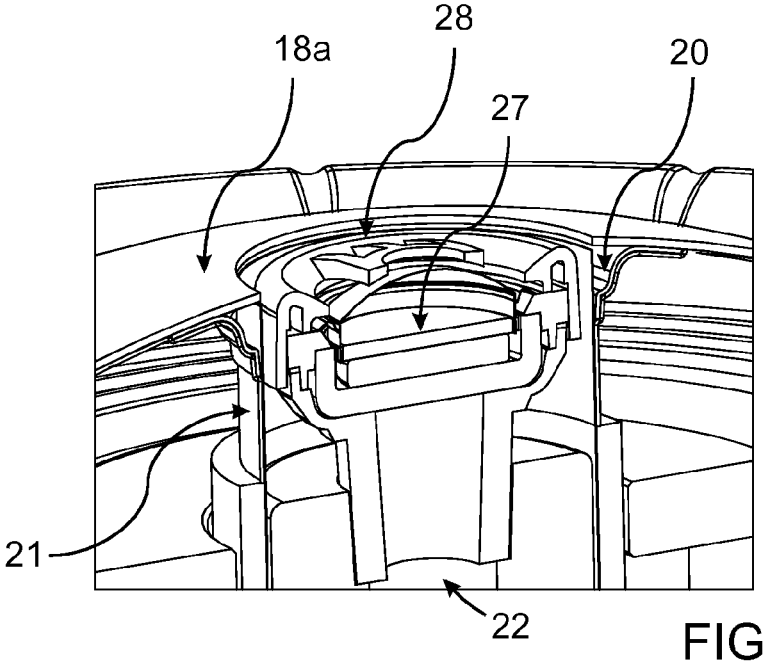
FIG. 8A is a close-up cut-away view of the seventh example loudspeaker transducer of the invention.

FIG. 8 shows a cut-away view and FIG. 8A a close up view that depicts a seventh example low profile loudspeaker transducer device 10*g*. The seventh example 10*g* is similar to the device in FIG. 6, but is configured as a low profile coaxial transducer with a high frequency tweeter transducer 27 mounted in the opening 28 cut out of diaphragm 18*a*. The tweeter 27 may be mounted on top of T-Yoke 12 and in vented pole piece opening 22, spaced away from the inner surface of voice coil former 21. Diaphragm 18*a* is attached to coupler 20, and coupler 20 is attached to voice coil former 21.

Figure 9:
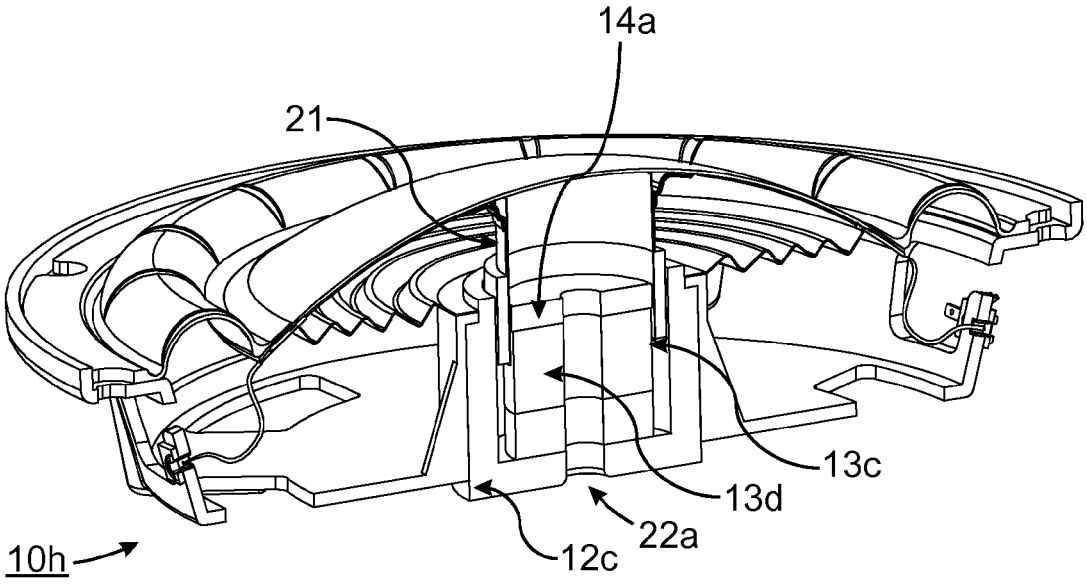
FIG. 9 is a cut-away view of an eighth example loudspeaker transducer of the invention.

FIG. 9 shows a cut-away view that depicts an eighth example low profile loudspeaker transducer device 10*h*. The fourth example 10*h* is similar to the device of FIG. 1 with the main difference being that of the magnet structure 13*c* mounted inside of the voice coil former 21. In this embodiment magnetic structure 13*c* preferably uses at least one high-energy magnet 13*d*, such as Neodymium or Samarium Cobalt. To better accommodate the magnet structure 13*c*, the U-Yoke structure 12*c* is arranged outside of the magnet structure 13*c* and voice coil former 21 and top plate 14*a* is positioned inside of voice coil former 21. In this configuration the opening 22 in the T-Yoke 12 of the other examples is replaced with a vented opening 22*a* in the U-Yoke 12*c* and magnet structure 13*c*. Alternatively, this embodiment 10*h*, magnet structure 13*c* may consist of one or more disc magnets without a hole in the center.

Figure 10:
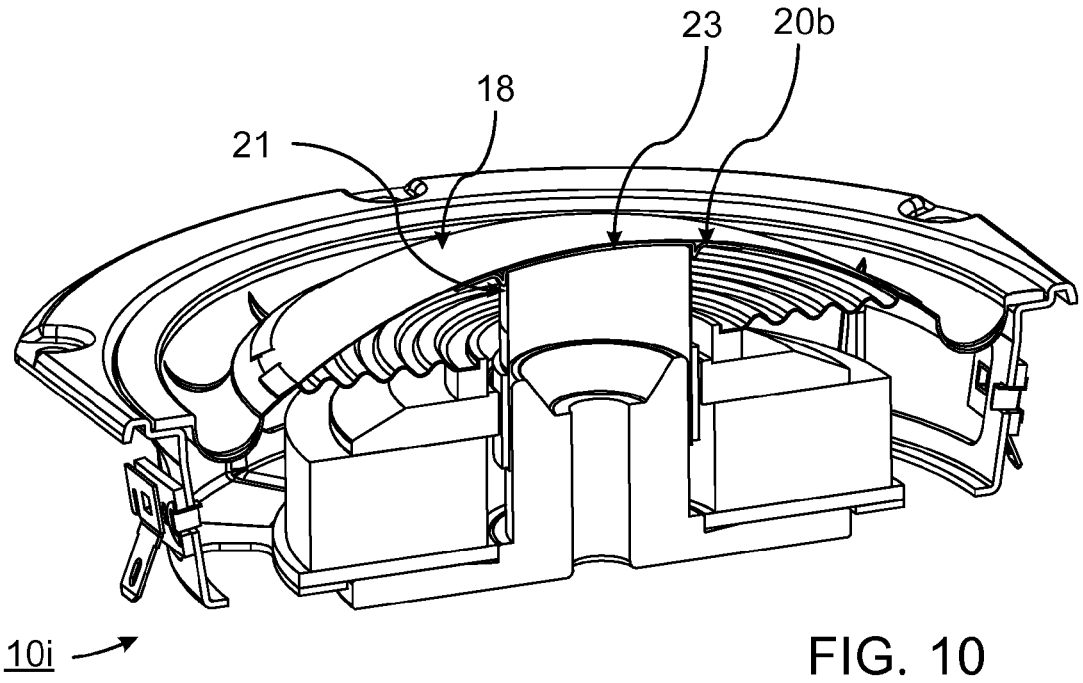
FIG. 10 is a cut-away view of a ninth example loudspeaker transducer of the invention.
Figure 10A:
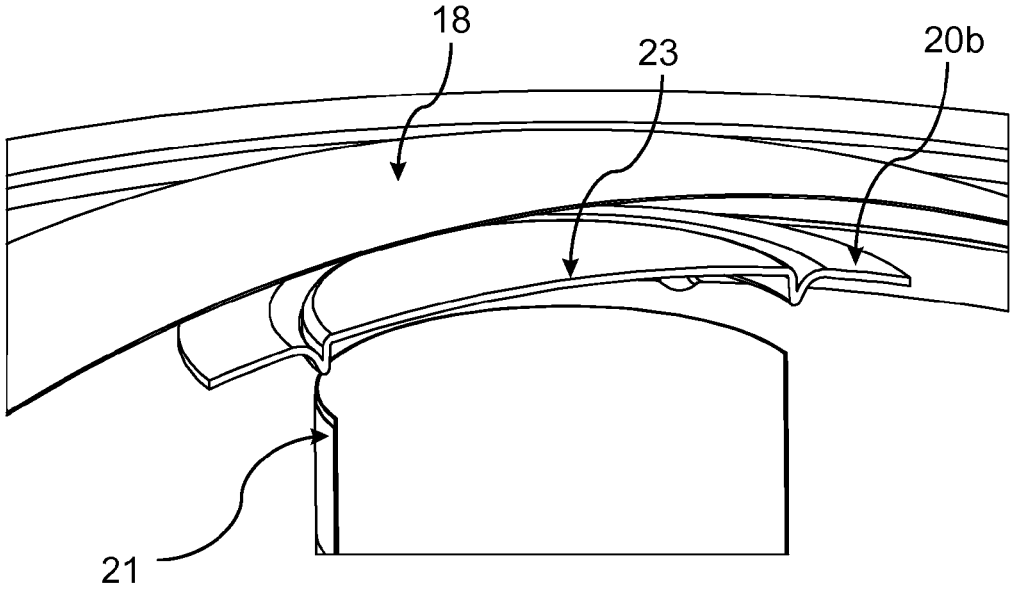
FIG. 10A is a close-up cut-away view of the ninth example loudspeaker transducer of the invention.

FIG. 10 shows a cut-away view and FIG. 10A a close up view that depicts a ninth example low profile loudspeaker transducer device 10*i*. The ninth example 10*i* is essentially the same as the device in FIG. 1 except that in this embodiment coupler 20*b* has a top cap 23 across the top of voice coil former 21 creating a very broad surface contact area between the coupler 20*b* and diaphragm 18, increasing the stiffness across the central portion of diaphragm 18, controlling diaphragm breakup modes and improving the frequency response of transducer 10*i*.

Figure 11:
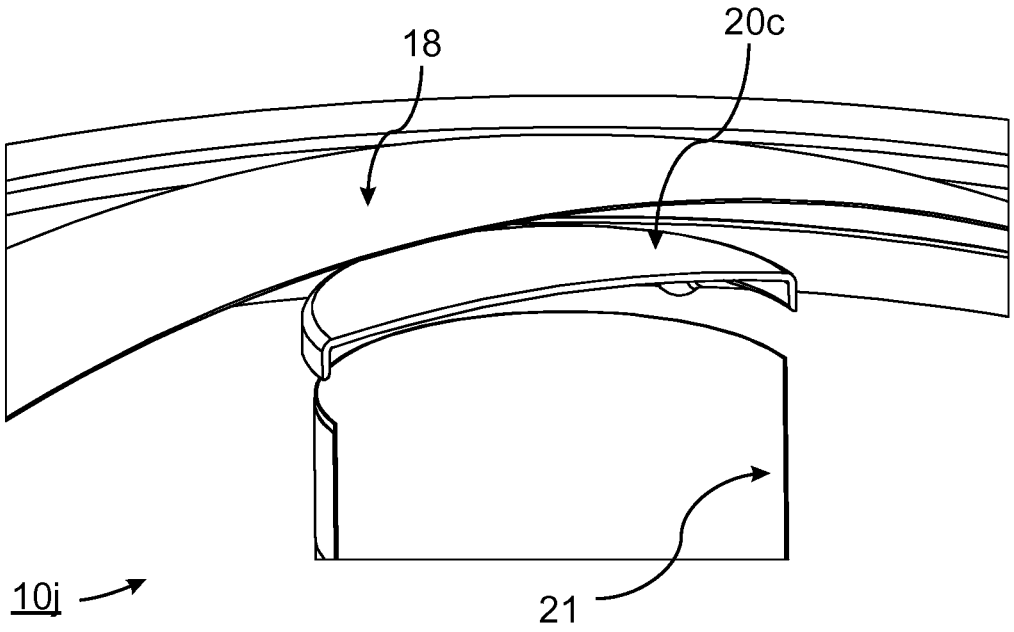
FIG. 11 is a close-up cut-away view of a tenth example loudspeaker transducer of the invention.

FIG. 11 shows a close up view that depicts a tenth example low profile loudspeaker transducer 10*j* similar to the device of FIG. 10 but with coupler 20*c* being a top cup that form fits over the top of voice coil former 21 and attach over a broad surface area of diaphragm 18 increasing structural integrity of diaphragm 18.

Figure 12:
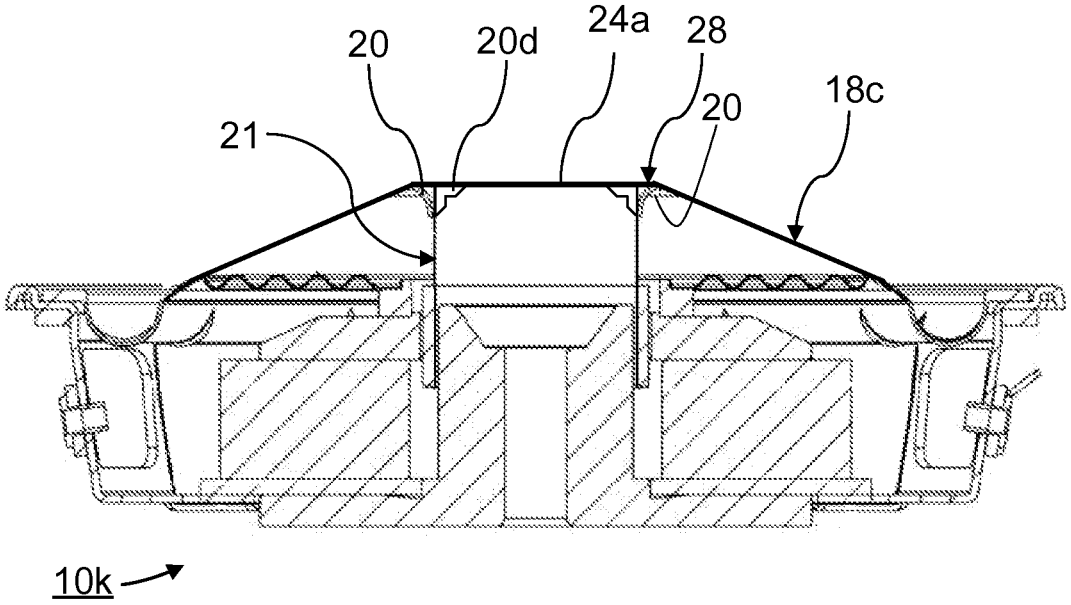
FIG. 12 is a cross-sectional view of an eleventh example loudspeaker transducer of the invention.
Figure 12A:
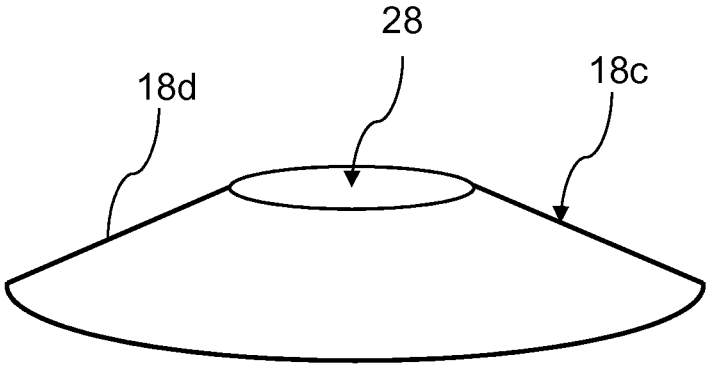
FIG. 12*a* is a view of a diaphragm component of the eleventh example loudspeaker transducer of the invention.

FIG. 12 shows a cross sectional view that depicts an eleventh example low profile loudspeaker transducer 10*k* of the same basic structure as that of FIG. 2, replacing the convex dome diaphragm 18 of FIG. 2 with a frustoconical, inverted convex cone structure 18*c* (shown in FIG. 12A) with top center opening 28. Diaphragm 18*c* is connected to coupler 20 and flat dust cap 24*a* is mounted in opening 28 and to one or both of voice coil former 21 and second coupler 20*d* mounted to the inside circumference of voice coil former 21. The side 18*d* of the cone diaphragm 18*c* may be a straight, or somewhat curved in a convex or concave form.

Figure 13:
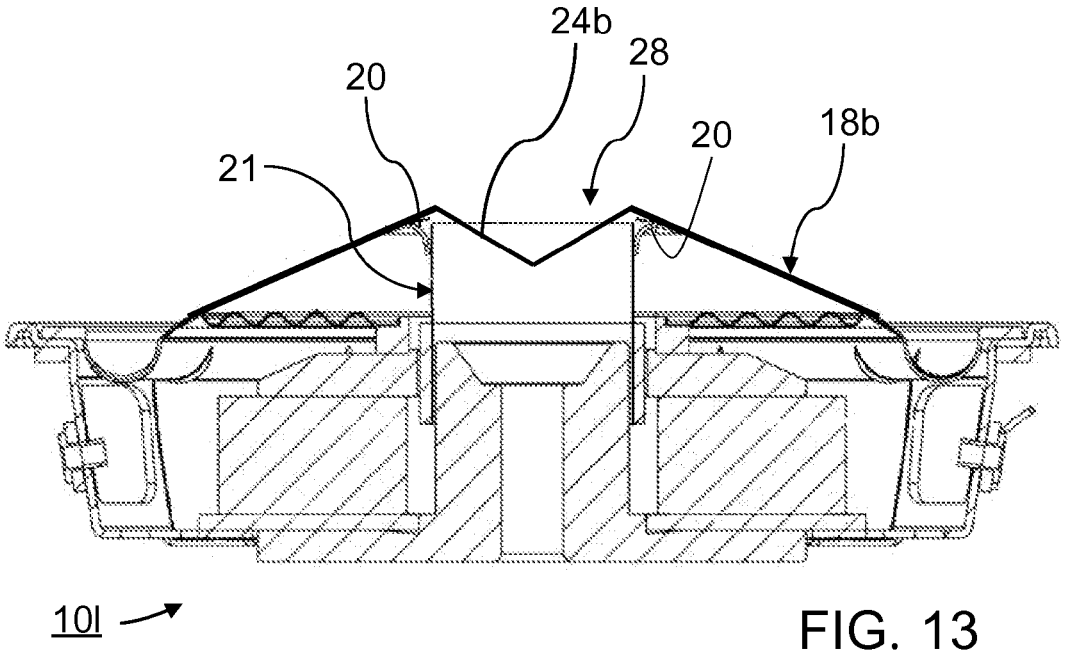
FIG. 13 is a cross-sectional view of a twelfth example loudspeaker transducer of the invention.

FIG. 13 shows a cross sectional view that depicts a twelfth example low profile loudspeaker transducer 101 of the same basic structure as that of FIG. 12, with the flat top dust cap 24*a* of FIG. 12 replaced by a substantially straight sided concave dust cap 24*b* mounted in opening 28 and to one or both of the voice coil former 21 and diaphragm 18*b* and diaphragm 18*b* attached to coupler 20.

Figure 14:
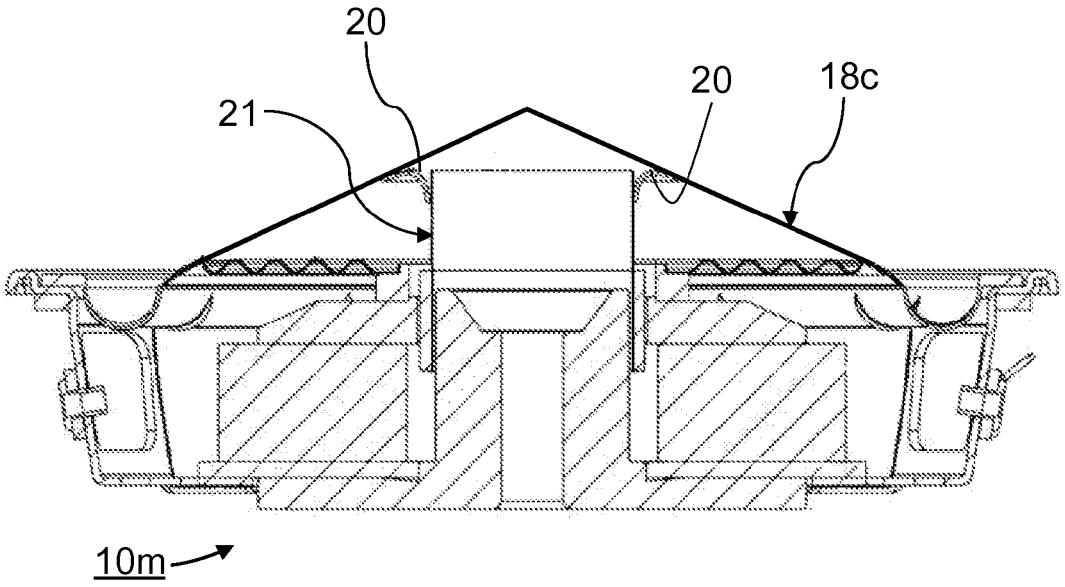
FIG. 14 is a cross-sectional view of a thirteenth example loudspeaker transducer of the invention.

FIG. 14 shows a cross sectional view that depicts a thirteenth example low profile loudspeaker transducer 10*m* of the same basic structure as that of FIG. 13, with the concave dust cap 24*b* and diaphragm 18*b* of FIG. 13 replaced by seamless inverted cone diaphragm which is coupled to voice coil former 21 through coupler 20 and to one or both of the voice coil former 21 and diaphragm 18*b* and diaphragm 18*b* attached to coupler 20.

Figure 15:
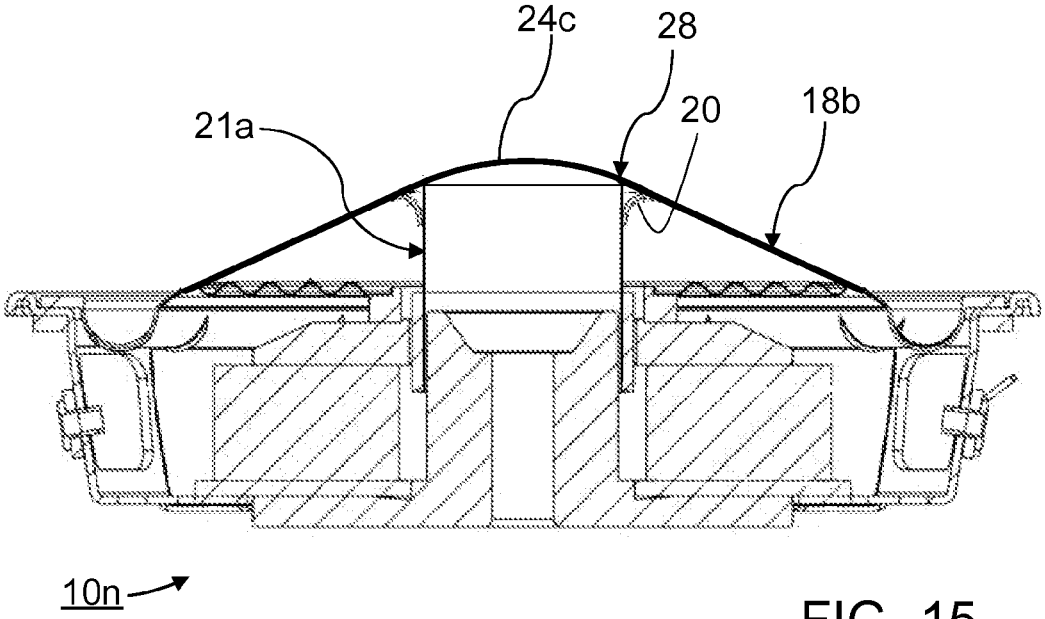
FIG. 15 is a cross-sectional view of a fourteenth example loudspeaker transducer of the invention.

FIG. 15 shows a cross sectional view that depicts a fourteenth example low profile loudspeaker transducer 10*n* of the same basic structure as that of FIG. 13, with the straight sided concave dust cap 24*c* of FIG. 13 replaced by rounded convex dust cap 24*c* attached to one or both of the voice coil former 21 and diaphragm 18*b*. Diaphragm 18*b* is attached to coupler 20 and to voice coil former 21.

In the various embodiments it is generally preferred to attach the diaphragm 18 to coupler 20 but optionally the diaphragm may be attached directly to the voice coil former 21 without coupler 20 or diaphragm 18 may be attached to both voice coil former 21 and coupler 20.

Figure 16:
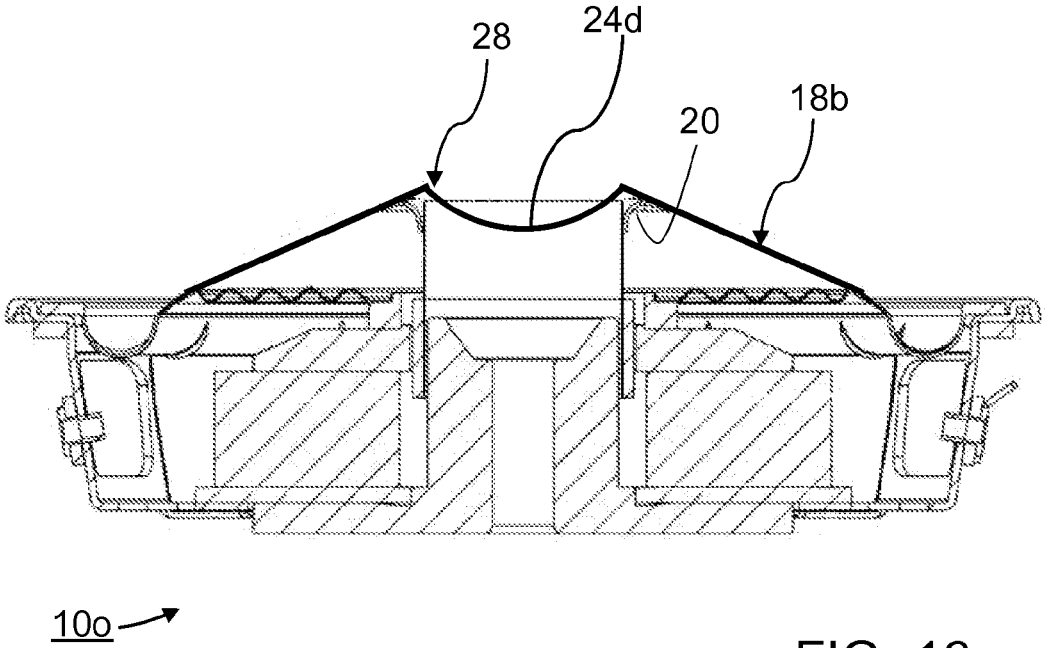
FIG. 16 is a cross-sectional view of a fifteenth example loudspeaker transducer of the invention.

FIG. 16 shows a cross sectional view that depicts a fifteenth example low profile loudspeaker transducer 10*o* of the same basic structure as that of FIG. 15, with the rounded convex dust cap 24*c* of FIG. 15 inverted to a concave form in this example 10*o*. Diaphragm 18*b* is shown as attaching to coupler 20 and dust cap 24*d* is attached to diaphragm 18*b* in this example.

Figure 17:
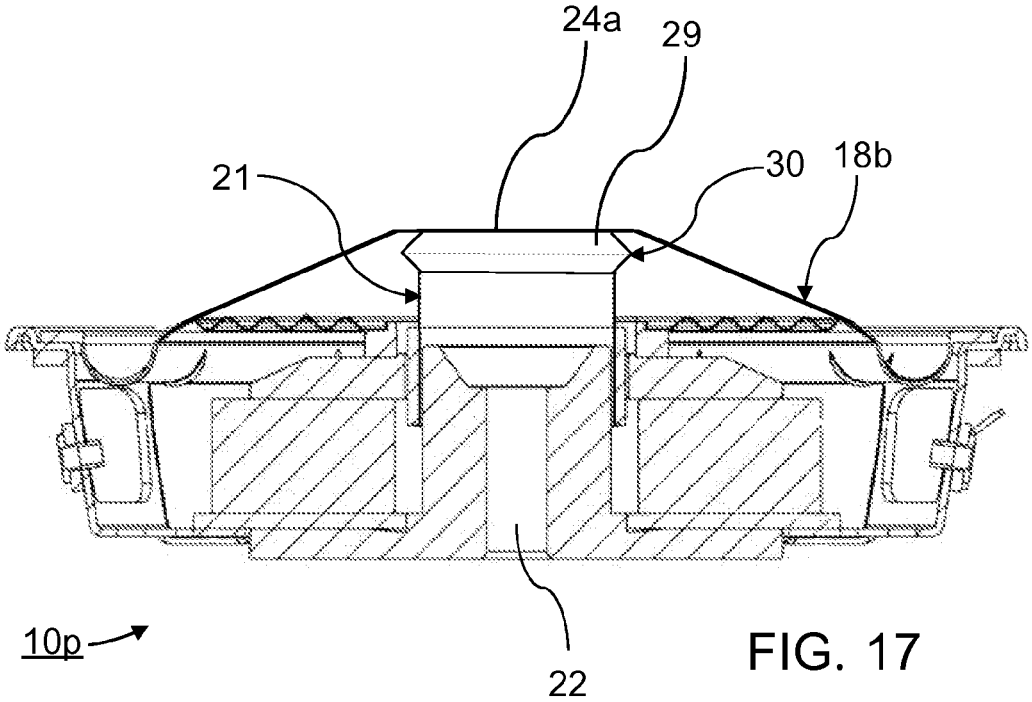
FIG. 17 is a cross-sectional view of a sixteenth example loudspeaker transducer of the invention.

FIG. 17 shows a cross sectional view that depicts a sixteenth example low profile loudspeaker transducer 10*p* which is similar to the embodiment in FIG. 12 except the standard coupler 20 of FIG. 12 is replaced with compliant coupler 29 which is attached to and between top dust cap 24*a* and voice coil former 21. Dust cap 24*a* is attached to diaphragm 18*b*. Compliant coupler 29 can be configured as an open structure with compliant sidewall 30 or can be a closed/sealed structure with the air contained within adding extra stiffness to the compliant coupler 29. Additionally, resistive losses can be incorporated into the compliant coupler 29. Compliant coupler 29 can be used as a low pass mechanical filter by progressively decoupling the voice coil former 21 from dust cap 24*a* and diaphragm 18*b*, essentially forming a bandpass system. Alternatively, Compliant coupler 29 can be configured as a mechanical resonator with the compliance of the coupler and the moving mass of diaphragm 18*b* forming a resonance that can be used to tune the amplitude response of the high frequencies of loudspeaker transducer 10*p*.

FIG. 18 shows a cross sectional view that depicts a seventeenth example low profile loudspeaker transducer 10*q* which is the same as the device of FIG. 2 with the addition of rear suspension 31 mounted below back plate 12*b* and attached to coupling rod 32 protruding through open t-yoke 22 coupling rear suspension 31 to diaphragm 18, with the rear suspension 31 adding an additional degree of stability to minimize voice coil former 21 rocking or twisting during large excursions of diaphragm 18. In alternative embodiments a coupling structure, replacing the coupling rod 32, could be placed outside of the magnet structure with an alternative rear spider that has a larger outside diameter, which may be a particularly useful approach with smaller diameter magnet structures, such as the Neodymium structure shown in FIG. 9. With the application of spider suspension 31 spider suspension 17 may be deleted from the transducer or may be used in conjunction with suspension spider 31.

In the various embodiments the diaphragm 18 can be made from a number of materials including aluminum, titanium textile cloth, paper pulp and a wide variety of materials known in the art for loudspeaker transducer materials.

In the various embodiments disclosed the invention utilizes the space provided by the protruding dome or inverted cone diaphragm 18 geometry to raise the magnetic structure 13 up into the concave inside cavity of the diaphragm 18 allowing the reduction of the total height of the transducer. Due to the requirement of a short distance between the diaphragm and the motor the spider 17 is configured into the disclosed configuration. The spider 17 design with inner periphery fixed and coupled to the top plate 14 of the motor/chassis and outer periphery attached to the dome diaphragm 18 is an essential element in the inventive transducer.

The dome or inverted cone shape diaphragm 18 embodies a characteristic of the invention that the diaphragm structure is preferred to have geometry with height and internal cavity volume. This can embody a dome-like, inverted cone or pyramid-like diaphragm form in terms of exhibiting its maximum height in the center of its geometry at some point over the voice coil former 21.

As it has been mentioned above, the shape of the diaphragm is not limited to the dome shape but any other geometries which deliver enough height between its center portion and the fixation point to the surround to harbor the magnetic motor structure; straight diaphragms (from the surround connection up until the maximum point, conical shape), flat top on the former, inverted cone geometries, and other generally convex forms can be effective.

Certain non-continuous surface diaphragm 18 constructions can also provide improved the acoustic performance of the transducer. This can attenuate the modes appearing at the center part of the diaphragm by increasing the stiffness of this area.

Different materials can be applied to each part of a two-part diaphragm 18*a* (as shown in FIG. 3) inner disk 24 portion of the diaphragm 18*a* and the outer portion of the diaphragm 18*a* structures. The join between these two pieces can take place through the coupler 20. The connection between the inner 24 disk and the coupler 20 is desired to be as strong as possible whereas the outer disk 18*a* is attached using soft or damping glue. This configuration works, at high frequencies, as an attenuator of the vibration transmitted to the outer disk 18*a* being useful to smooth peaks caused by a break-up phenomenon and can alternatively create a low pass filter at high frequencies and progressively reducing effective diaphragm diameter with increasing frequency.

The coupler 20 can improve the acoustic and mechanical capability of the transducer 10 in that the coupler device 20 increases the stiffness of the center area of the diaphragm 18 radiation surface which has beneficial effects in the frequency response of the driver 10 (extension of the piston radiation area); especially at the high end of its working frequency range where increasing the rigidity of the diaphragm 18 helps to control the amplitude of its vibration modes.

Besides increasing the stiffness of the center area of the diaphragm 18 radiation surface the coupler 20 also stiffens the upper end of the voice coil former 21 neck, ensuring a rigid and reliable connection to diaphragm 18 improving frequency response and creating stronger connections for a greater mechanical power handling.

The coupler device 20 can be configured such that it has multiple connection points from the voice coil former 21 to the diaphragm 18 balancing the force provided by the voice coil 19. This configuration also further contributes to increased control of the vibration modes of the diaphragm 18.

Depending on the material the rigid coupler 20 or compliant coupler 30 is made of, the damping of the connection system can be modified and adapted to desired characteristics. Accordingly, the compliant coupler 30 of as one example is shown in FIG. 30, can operate as a low pass filter, damper or resonant system.

Additionally, a ring with an L-shaped cross section, or a small cone shaped piece to join the voice coil former 21 to the diaphragm 18 surface, enables the use of a continuous diaphragm 18 surface and avoids the structurally weaker butt joint that would be normally be formed by connecting only the voice coil former 21 directly to the diaphragm 18 without the coupler 20.

Figure 19:
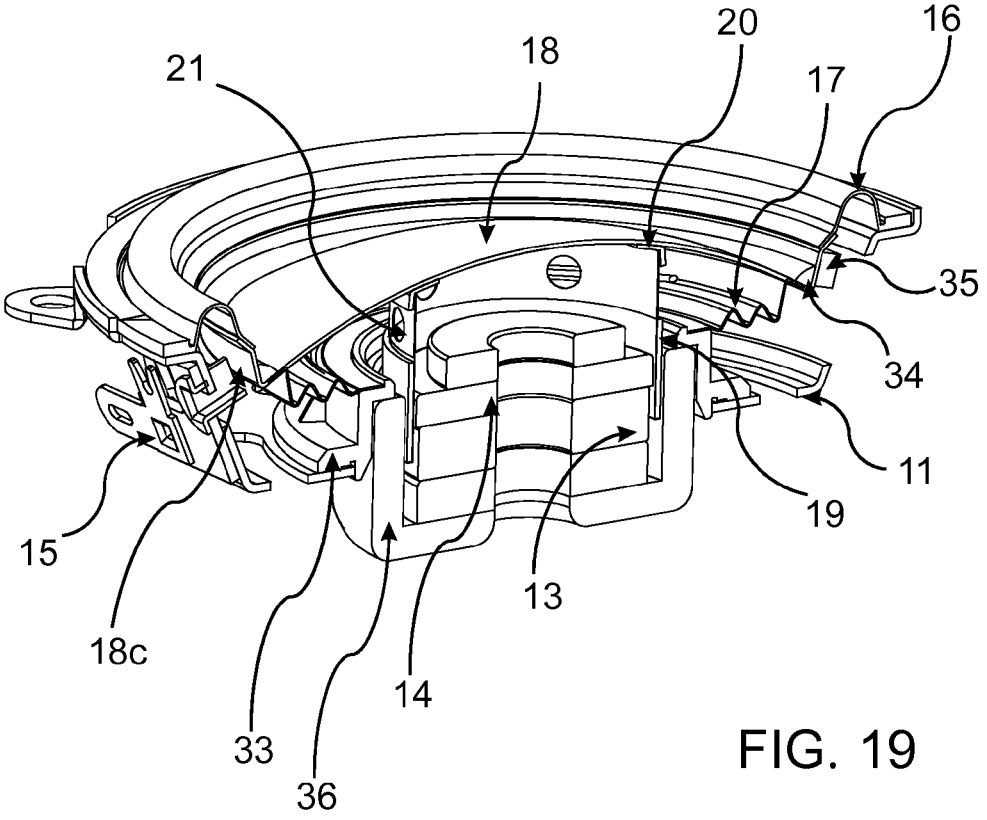
FIG. 19 is cut-away view of an eighteenth example loudspeaker transducer of the invention.

One of the possible diaphragm geometries that meets the requirements aforementioned also includes a radiation surface shaped in a way that exhibits a first dome-like geometry (18) which harbors the magnetic motor structure of the speaker and whose body edge is folded upwards forming an outer cone-like second geometry (18*e*) (FIG. 19). The second geometry body meets the surround (16) at the end of its structure. The outer cone could be made of the same piece as the central dome, or be a second separate piece attached or coupled to the first geometry, with its inner diameter virtually bigger than the magnetic motor structure housed by the central dome. Underneath this double-geometry diaphragm structure and at its fold or groove point or section, or nearby (where the two geometries "meet" each other), the outer periphery of the spider suspension 17 is connected or coupled (unlike the rest of the embodiments, the spider element is not attached at, or nearby, the end of the radiation surface body). This folded dome helps to cope with the disadvantage of having dynamic coil loudspeakers with relatively big and low profile dome diaphragms whose stiffness is similar to that presented by flat geometries.

The groove or fold area can be treated to improve the behavior of the loudspeaker at the break-up frequency region by adding either a stiffening or damping element, like specific type/s of glue/s, on the groove surface (34). With the same objective (controlling the smoothness of the sound pressure level curve), stiffening or damping elements, like glue or rubber mass, can be placed/attached on the back side of the second geometry (35); their amount and position depends on the desired effect on the driver's performance; this will help to break the vibration modes of the diaphragm at certain frequencies and consequently distributing their energy over a wider area of the audible spectrum.

A plastic ring or brushing (33) is disposed as a coupling element between the magnetic motor structure and the basket. This element provides a fitted wrapping of the motor strongly keeping it in place and connecting it to the basket.

Manufacturing methods can center the voice coil former 21 in the gap by utilizing a fixture, which is removed from the front face of the transducer once the spider 17 and the cone diaphragm 18 have been properly glued to the basket and the former. This method takes advantage of the hole 28 in the center of a conical cone diaphragm 18*c* (shown in FIG. 12A) geometry to access to the fixture. The assembly of a dust cup 24*a* over or on the voice coil former 21, closing this hole 28, completes the process.

As an alternative preferred construction method, the fixture which positions the voice coil in its predetermined placement must be removed from the back side of the transducer as the dome diaphragm does not present any aperture from which accessing to the centering device. In order to do that, the T-yoke 12 comprises two pieces: a regular T-yoke 12 and an extra back plate 11*a* (shown in FIG. 1). This extra back plate 11*a* is located in between the magnet structure 13 and the bottom, or back plate 12*a*, of the regular T-yoke 12. Both, the basket frame 11 and the motor (which comprises only the magnet 13 and the top plate 14 in this case) rest on the back plate 12*b* allowing the T-yoke 12 to be easily unattached from the transducer 10 structure. This action does not compromise the effectiveness of the transducer 10 assembly or production process and takes place after the successful assemblage of the diaphragm 18 and spider 17 in the system. Removing the T-yoke 12 gives access to the fixture, which was placed on the pole piece 12*a*. Once the fixture is taken apart, the T-yoke 12 is positioned back and glued/screwed to the back plate 12*b*. A proposed assembly method is described step-by-step as follows:

1. Assemble the back plate 12*b* and the T-yoke 12 (No glue is used).
2. Attach the magnet 13, top plate 14 and aluminum ring (consecutively) to the back plate.
3. Attach together the basket frame 11 and the back plate 12*b* using glue, screws or both.
4. Fix the inner periphery of the spider 17 on the aluminum ring.
5. Attach the coupler 20 (ledge-like piece) to the former using a flat surface to align the top parts of these two elements (if the coupler is made of two parts the process does not vary, the second part of the coupler 20 which looks like a dust cup going on the former will be attached after the first element).
6. Put the fixture on the pole piece 12*a* to set the voice coil 19 in its optimal placement in the motor gap.
7. Between top plate 14 and pole piece 12*a*, fit the voice coil former 19 in the fixture.
8. Attach the dome diaphragm 18 to the voice coil former 21 by means of the coupler 20.
9. Glue the lead wires underneath the dome to the surround.
10. Fix the dome diaphragm 18 to the spider 17 and the basket 11.
11. Remove the T-yoke 12 from the structure and the fixture from the pole piece 12*a*.
12. Place the T-yoke 12 back to its position and fix it there.

Similar to the ferrite magnet version as shown in FIG. 1, this method applied to the Neodymium magnet version (illustrated in FIG. 9) implies removing the fixture from the backside of the transducer 10 in the last step of the assembly. The basket/frame 11 design of the invention facilitates the extraction of the motor (U-yoke 12*c*, neo magnet 13 and top plate 14*a*) allowing access to the fixture. None of the moving parts are directly attached to the magnetic motor but instead, to the basket. There is no aluminum ring in this version.

It is evident that those skilled in the art may now make numerous uses of and departures from the specific apparatus and techniques disclosed herein without departing from the inventive concepts. Consequently, the invention is to be construed as embracing each and every novel feature and novel combination of features disclosed herein, and the examples of the present invention disclosed herein are intended to be illustrative, but not limiting, of the scope of the invention Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention.

The invention claimed is:

1. A low profile loudspeaker transducer, comprising:

a magnet;

a top plate disposed above the magnet;

a voice coil former having a first end which terminates above the top plate;

a diaphragm extending over the top plate;

a coupler connecting the diaphragm to the first end of the voice coil former;

a first suspension disposed beneath the diaphragm and affixed at one end to the diaphragm and at a second end to the top plate; and a second suspension extending from an outer edge of the diaphragm to a frame of the loudspeaker transducer.

2. The low profile loudspeaker transducer according to claim 1, wherein the magnet and the top plate form a magnetic motor which is disposed, at least partially, within a volume created by the diaphragm.

3. The low profile loudspeaker transducer according to claim 1, wherein the diaphragm extends over the voice coil former or wherein the diaphragm terminates at the first edge of the voice coil former and the transducer further comprises a top cover which extends from the edge of the diaphragm and extends over the voice coil former.

4. The low profile loudspeaker transducer according to claim 1, wherein the first suspension comprises a spider suspension having a corrugated cross-sectional profile wherein the second end of the spider suspension is affixed to a ring separator mounted on the top pate, the ring separator extending on the top plate around the voice coil former.

5. The low profile loudspeaker transducer according to claim 4, wherein the first suspension comprises two of said spider suspensions, one disposed atop the other, the second ends of both spider suspensions being affixed to said ring separator.

6. The low profile loudspeaker transducer according to claim 1, wherein the second suspension is a surround suspension having a concave cross-sectional profile and being disposed beneath the first suspension.

7. The low profile loudspeaker transducer according to claim 1, wherein the second suspension is a surround suspension having a convex cross-sectional profile and being disposed above the first suspension.

8. The low profile loudspeaker transducer according to claim 1, wherein the coupler is affixed at one end to the voice coil former and includes a bonding surface at an opposite end configured to be affixed to the diaphragm, wherein the bonding surface of the coupler is larger than that provided by the voice coil former.

9. The low profile loudspeaker transducer according to claim 8, wherein the coupler comprises a top cap which extends over the voice coil former and serves as the bonding surface for affixing the diaphragm to the coupler.

10. The low profile loudspeaker transducer according to claim 1, wherein the diaphragm has a cross-sectional profile which is conical, frustoconical, curvilinear, linear, triangular, or a combination thereof.

* * * * *